US008232491B2

(12) United States Patent
Tatehata et al.

(10) Patent No.: US 8,232,491 B2
(45) Date of Patent: Jul. 31, 2012

(54) MOVABLE CONTACT ELEMENT AND SWITCH USING THE SAME

(75) Inventors: Naoki Tatehata, Kyoto (JP); Takefumi Inoue, Nara (JP); Koji Tanabe, Osaka (JP); Yousuke Chikahisa, Hyogo (JP)

(73) Assignee: Panasonic Corporation, Osaka (JP)

( * ) Notice: Subject to any disclaimer, the term of this patent is extended or adjusted under 35 U.S.C. 154(b) by 704 days.

(21) Appl. No.: 12/129,824

(22) Filed: May 30, 2008

(65) Prior Publication Data

US 2008/0302642 A1 Dec. 11, 2008

(30) Foreign Application Priority Data

Jun. 7, 2007 (JP) ..... 2007-151405

(51) Int. Cl.
*H01H 9/02* (2006.01)

(52) U.S. Cl. ..... 200/314; 200/513

(58) Field of Classification Search ..... 200/310–317, 200/512–517; 362/23, 29, 84
See application file for complete search history.

(56) References Cited

U.S. PATENT DOCUMENTS 5,595,288 A 1/1997 Matsui et al.
7,465,961 B2 12/2008 Masuda et al.
7,525,454 B2 4/2009 Jung et al.
7,677,781 B2 * 3/2010 Ishihara et al. ..... 200/310
2007/0279932 A1 * 12/2007 Ishihara et al. ..... 362/602

FOREIGN PATENT DOCUMENTS

CN 1095178 C 11/2002
CN 1542497 A 11/2004
CN 1866435 A 11/2006
JP 2006-318905 A 11/2006

OTHER PUBLICATIONS

Chinese Office Action for 2008 10099514.1, May 4, 2010.
Chinese Office Action for Application No. 200810099514.1, Dec. 8, 2010, Panasonic Corporation.

* cited by examiner

*Primary Examiner* — Amy Cohen Johnson
*Assistant Examiner* — Marina Fishman
(74) *Attorney, Agent, or Firm* — RatnerPrestia

(57) ABSTRACT

A movable contact point made of a thin conductive metal sheet in an approximate dome shape is attached to the lower surface of a transparent base sheet, and the base sheet is provided at the upper or the lower surface with a fluorescent layer in the location above the movable contact point. Since, in the make-up, light can be made available for illumination in many colors other than that generated from a light emitting device, a movable contact element, as well as a switch formed using the contact element, that offers various illuminating modes can be implemented in a simple structure.

8 Claims, 5 Drawing Sheets

MOVABLE CONTACT ELEMENT AND SWITCH USING THE SAME

TECHNICAL FIELD

The present invention relates to a movable contact element used for the operation of many kinds of electronic apparatus, and a switch using the movable contact element.

BACKGROUND ART

An increasing number of recent electronic apparatus, more specifically portable terminal units of a portable telephone system among other equipment, illuminate their push buttons, display sheets, etc. using light emitting diodes, electro luminescent elements or the like devices in order to facilitate easier operation of the units and clearer recognition of messages. The illuminating means are requested to be able to provide lights for creating various modes at inexpensive cost.

A conventional movable contact element and a switch incorporating the contact element are described in the following with reference to FIG. 7. FIG. 7 shows a cross sectional view of a conventional switch. In FIG. 7, transparent light conducting sheet 1 in a flexible film state is formed of light conducting layer 1A sandwiched by upper protective layer 1B and lower protective layer 1C. For easier description of the film structure, the drawings are shown enlarged in the direction of film thickness. A plurality of movable contact points 3 made of a thin conductive metal sheet in an approximate dome shape are affixed to the lower surface of light conducting sheet 1 using an adhesive agent (not shown), and light conducting layer 1A has at the location above movable contact point 3 a plurality of light causing sections 1D which are of an uneven shape. Movable contact element 4 has such a make-up.

On the upper surface of substrate 5 having a plurality of circuit patterns (not shown) formed at the upper and lower surfaces, a plurality of fixed contact points 6 are provided, which fixed contact points including central fixed contact point 6A of approximate round shape and a plurality of outer fixed contact points 6B of a horse shoe shape surrounding the central fixed contact point. Movable contact point 3 is disposed above the fixed contact points in a manner where the outer circumference is resting on outer fixed contact points 6B while the center of lower surface is opposing to central fixed contact point 6A with a certain specific clearance secured in between. A plurality of light emitting diodes or the like light emitting devices 7 are mounted on substrate 5 at a place which is the right to light conducting sheet 1. The light emitting face of light emitting device 7 opposes to the end-face of light conducting layer 1A of light conducting sheet 1 at the right. Operating body 8 made of an insulating resin material in a sheet form includes transparent portion 8A and light blocking portion 8B covering the above. Each of a plurality of operating sections 8C has at the top plane its specific display section 8D, where transparent portion 8A is exposed to demonstrate a certain specific letter or a symbol of its own. Pressing section 8E, which is protruding downward, is having contact with the upper surface of light conducting sheet 1 at the location corresponding to the center of movable contact point 3. A conventional switch is structured as such.

A switch having the above-described make-up is mounted on the operation panel of an electronic apparatus, and central fixed contact point 6A, outer fixed contact points 6B and light emitting device 7 are connected via circuit pattern with an electronic circuit (not shown) of the electronic apparatus.

When a certain specific operating section 8C of operating body 8 is pressed downward, pressing section 8E corresponding to the operating section gives pressure on the upper surface of light conducting sheet 1. Light conducting sheet 1 bends to press down movable contact point 3 of an approximate dome shape at the center. As soon as the pressing force reaches at a certain level, movable contact point 3 elastically reverses accompanying a click feeling, to make contact at the center of the lower surface with central fixed contact point 6A. Then, central fixed contact point 6A and outer fixed contact point 6B are electrically connected via movable contact point 3. When the pressing force given on operating section 8C is withdrawn, movable contact point 3 reverses back upward due to elastic self restorative force, and the center of lower surface departs from central fixed contact point 6A, leaving the electrical connection between central fixed contact point 6A and outer fixed contact point 6B disconnected. The operation of an electronic apparatus is switched to perform different functions in accordance with the above-described procedure of electrical connection/disconnection.

If, at this moment, a certain voltage is applied on light emitting device 7 from the electronic circuit of electronic apparatus, light emitting device 7 starts generating light, which light goes into light conducting layer 1A from the right end-face of light conducting sheet 1 to illuminate the entire light conducting layer 1A. The light is reflected by light causing section 1D of the uneven shape within light conducting layer 1A; thus, a plurality of light causing sections 1D generates light. The light proceeds through upper protective layer 1B to illuminate display section 8D of operating body 8 from the underneath. In this way, an operator can easily recognize the letters or symbols of respective operating sections 8C even in a dark environment.

Patent Document 1 is an example of prior art technical information related to the present patent application.

In the above-described conventional movable contact element and a switch incorporating the movable contact element, a plurality of light emitting devices 7 provides light for the entire portion of light conducting layer 1A of light conducting sheet 1. A plurality of display sections 8D of operating body 8 is illuminated with the light; viz. the color of light emitted from light emitting device 7 determines the illumination color for operating body 8. This means that a plurality of light causing sections 1D can generate only a single color. Furthermore, each time when other illuminating color is needed, other light emitting device 7 had to be used or different light emitting devices had to be used in combination. This takes extra time. This was a problem for making illumination with different colors in various modes.

Patent Document 1

Japanese Patent Unexamined Publication No. 2006-318905

SUMMARY OF THE INVENTION

The present invention has the following structure. Movable contact element is formed of a transparent base sheet and attached at the lower surface with a movable contact point made of a thin conductive metal sheet in an approximate dome shape, and the transparent base sheet is provided at the upper or the lower surface with a fluorescent layer in the location above the movable contact point. When a switch is formed using the movable contact element, operating body or other part of the switch can be illuminated by a light generated from the fluorescent layer, which light having a different color other than that from the light emitting device. Thus the movable contact element is capable of offering various modes of illumination with an easy make-up.

Furthermore, when the fluorescent layer is provided in a plurality each demonstrating a different color respectively, a single light emitting device can drive respective fluorescent layers for emitting different colors. Thus, it can present illumination with more variations inexpensively.

REFERENCE MARKS IN THE DRAWINGS

1 Light Conducting Sheet
1A Light Conducting Layer
1B Upper Protective Layer
1C Lower Protective Layer
1D Light Causing Section
3 Movable Contact Point
4 Movable Contact Element
5 Substrate
6 Fixed Contact Point
6A Central Fixed Contact Point
6B Outer Fixed Contact Point
7 Light Emitting Device
8 Operating Body
8A Transparent Section
8B Light Blocking Section
8C Operating Section
8D Display Section
8E Pressing Section
11 Base Sheet
11A, 11B Reflection Section
12 Adhesive Layer
13, 13A, 13B, 13C, 13D Fluorescent Layer
14 Separator
15 Movable Contact Element
17 Light Emitting Device

DETAILED DESCRIPTION OF PREFERRED EMBODIMENT

Exemplary embodiment of the present invention is described below. For easier illustration of the structures, the drawings have been provided enlarged in the direction of thickness. Those portions identical to those described in the Background Art are designated by using the same symbols, and detailed description on which portions has been simplified.

(Exemplary Embodiment)

Figure 1:
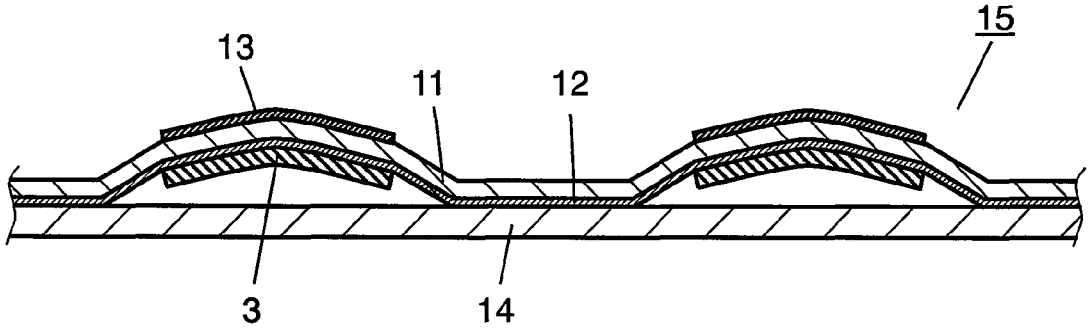
FIG. 1 shows a cross sectional view of a movable contact element in accordance with an exemplary embodiment of the present invention.
Figure 2:
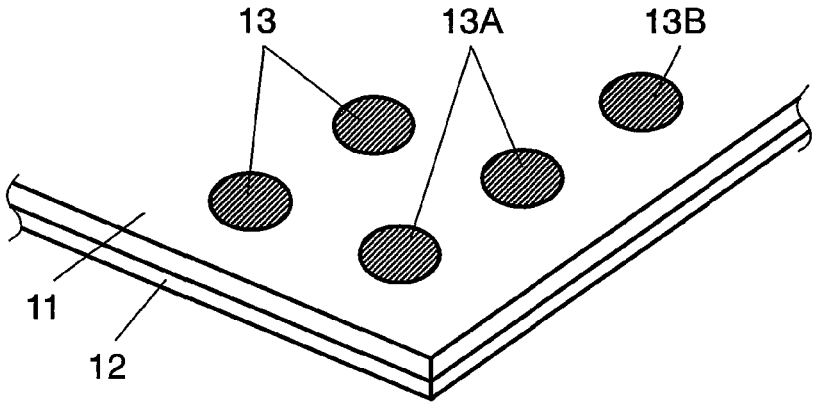
FIG. 2 is an exploded perspective view showing a main part in accordance with an exemplary embodiment of the present invention.

FIG. 1 shows the cross sectional view of movable contact element 15 in accordance with an exemplary embodiment of the present invention. FIG. 2 is an exploded perspective view showing a main part. In FIG. 1 and FIG. 2, base sheet 11 is made of polyurethane or the like transparent material having a thickness of 5-200 μm; what is preferred is a polyethylene terephthalate or polycarbonate film of 25-100 μm thick. The base sheet is coated at the lower surface with adhesive layer 12 of an acrylic resin, silicone, butyl rubber, etc.

Movable contact point 3 is formed of a thin conductive metal sheet of copper alloy, steel, etc. in an approximate dome shape. A plurality of movable contact points 3 are attached to the lower surface of base sheet 11, and base sheet 11 is provided at the upper surface with a plurality of fluorescent layers 13 formed using transparent resin of polyester, epoxy, acrylic, etc. or dye dispersed with zinc sulfide at the location corresponding to the movable contact point 3.

Movable contact element 15 has separator 14 for protection, which is made of a polyethylene terephthalate film or a paper material affixed to the lower surface of base sheet 11. Separator 14 covers the lower surface of movable contact point 3 of movable contact element 15; so, it is protected from dusts and oil stains, etc. during its shelf storage and transportation before being assembled into a finished switch.

Figure 3:
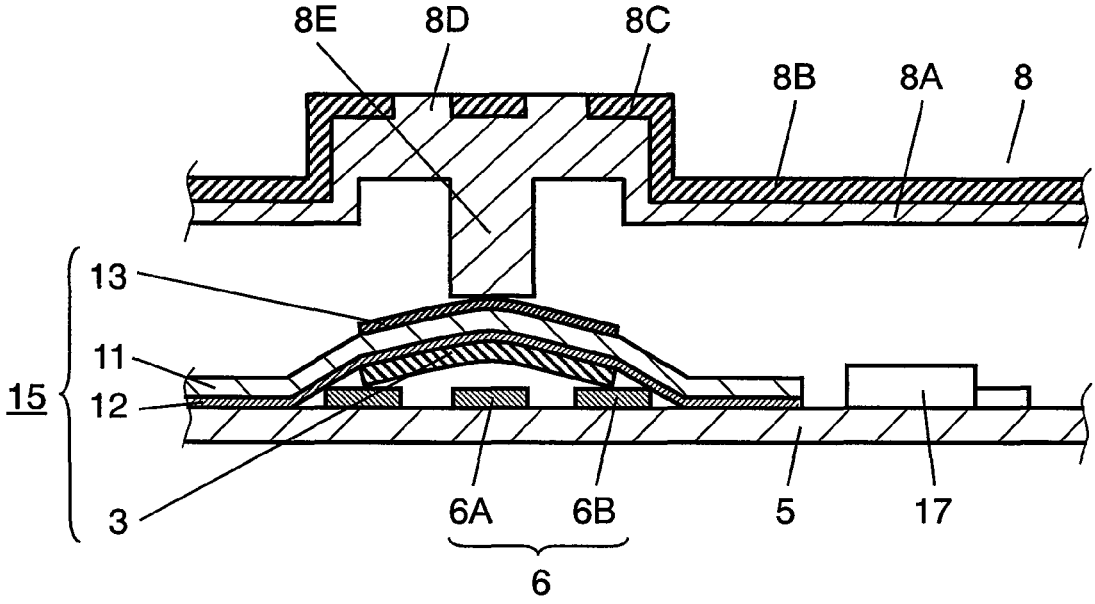
FIG. 3 shows a cross sectional view of a switch in accordance with an exemplary embodiment of the present invention.

FIG. 3 is a cross sectional view which shows a switch in accordance with an exemplary embodiment of the present invention. In FIG. 3, substrate 5 is a film of polyethylene terephthalate or polycarbonate, or a board of phenolic paper or epoxy resin containing glass material. Substrate has a plurality of wiring patterns (not shown) formed with copper or the like material provided on the upper and the lower surfaces. On the upper surface of substrate 5, there is a plurality of fixed contact points 6 made of copper, carbon, etc.; viz. central fixed contact point 6A of an approximate round shape and a plurality of outer fixed contact points 6B having a horse shoe shape disposed surrounding the central fixed contact point. Movable contact element 15, after its separator 14 is peeled off, is attached onto the upper surface of substrate 5, with the outer circumferential edge of respective movable contact points 3 on outer fixed contact points 6B; then, the lower surface of movable contact point 3 will be opposing at the central part to central fixed contact point 6A with a certain gap in between.

Light emitting device 17 represents an LED or the like chip which emits the ultra-violet or blue ray of a wavelength around 400 nm. Light emitting device 17 is mounted on substrate 5 at the right of movable contact element 15, with its light emitting face directed towards the right end-face of base sheet 11. Operating body 8 made of insulating resin material in a sheet form includes transparent section 8A and light blocking section 8B which covers the upper surface of transparent section 8A. Each of a plurality of operating sections 8C has at the top plane its specific display section 8D, where transparent portion 8A is exposed to demonstrate a certain specific letter or a symbol of its own. Pressing section 8E, which is protruding downward, is having contact with the upper surface of base sheet 11 at the location corresponding to the center of movable contact point 3. A switch in accordance with the present invention is structured as such. A switch having the above-described make-up is mounted on the operation panel of an electronic apparatus, and central fixed contact point 6A, outer fixed contact points 6B and light emitting device 7 are connected via circuit pattern with an electronic circuit (not shown) of the electronic apparatus.

When a certain specific operating section 8C of operating body 8 is pressed downward, pressing section 8E corresponding to the operating section gives pressure on the upper surface of base sheet 11. Base sheet 11 bends to press down movable contact point 3 of an approximate dome shape at the center. As soon as the pressing force reaches at a certain level, movable contact point 3 elastically reverses downward, accompanying a click feeling, to make contact at the center of the lower surface with central fixed contact point 6A. Then, central fixed contact point 6A and outer fixed contact point 6B are electrically connected via movable contact point 3. When the pressing force given on operating section 8C is withdrawn, movable contact point 3 reverses back upward due to elastic restorative force, and the center of lower surface departs from central fixed contact point 6A, leaving the electrical connection between central fixed contact point 6A and outer fixed contact point 6B disconnected. The operation of an electronic apparatus is switched to perform different functions in accordance with the above-described procedure of electrical connection/disconnection.

Then, if a certain voltage from the electronic circuit of electronic apparatus is applied on light emitting device 17, light emitting device 17 starts generating light, which light goes into base sheet 11 from the right end-face of movable contact element 15. The light coming through base sheet 11 excites fluorescent layer 13 to emit light, which light illuminates display section 8D of operating body 8 from underneath. Therefore, one can easily recognize the letter or symbol of operating section 8C even in a dark ambient.

Fluorescent layer 13 contains certain fluorescent material, so the light emitted from the fluorescent layer has a certain color that is different from that of light emitting device 17. In this way, operating section 8C is illuminated with the light of different color from that of light emitting device 17. Namely, in a case where the light emitting device is generating ultraviolet lay of wavelength 380 nm or shorter, for example; fluorescent layer 13 emits green light if the layer is formed of a copper-added zinc sulfide. Yellow-green light is emitted if the layer is formed of a zinc sulfide added with copper and aluminum. Red light comes from the layer formed of a silver-added zinc sulfide, while orange light from the layer of a manganese-added zinc sulfide.

In a case where light emitting device 17 is emitting violet or blue light of around 400-450 nm wavelength and fluorescent layer 13 is formed of a fluorescent dye of stilbene system, the layer emits white color light. If fluorescent layer 13 is formed of a fluorescent dye of rhodamine system, the layer emits red light, while the layer of a fluorescent dye of azobenzene system emits green light.

In a case where fluorescent layer 13 is formed of a cerium-added yttrium aluminum garnet, the layer emits yellow light. So, a white light can be synthesized by using the yellow light, obtained after adjusting fluorescent layer 13 in the thickness and the area, etc., and also using a light emitting device 17 that emits blue light.

Besides, fluorescent layer 13 may be formed using oxide or nitride added with other rare earth ions. Operating section 8C can be illuminated red by using europium, and green with terbium, for example.

Namely, operating section 8C can be illuminated in many colors different from the color of light coming from light emitting device 17, by using a light emitting device 17 that emits ultra-violet ray or visible violet/blue rays of around 400 nm wavelength for exciting fluorescent layer 13 disposed on the upper surface of base sheet 11 at the location above movable contact point 3.

Furthermore, as shown in FIG. 2, fluorescent layers 13A and fluorescent layer 13B, among a plurality of layers, can be excited for emitting light respectively in different colors. For example, making fluorescent layer 13A to emit white light, while fluorescent layer 13B orange light. Thus, it can enrich the mode of illuminating.

Figure 4A:
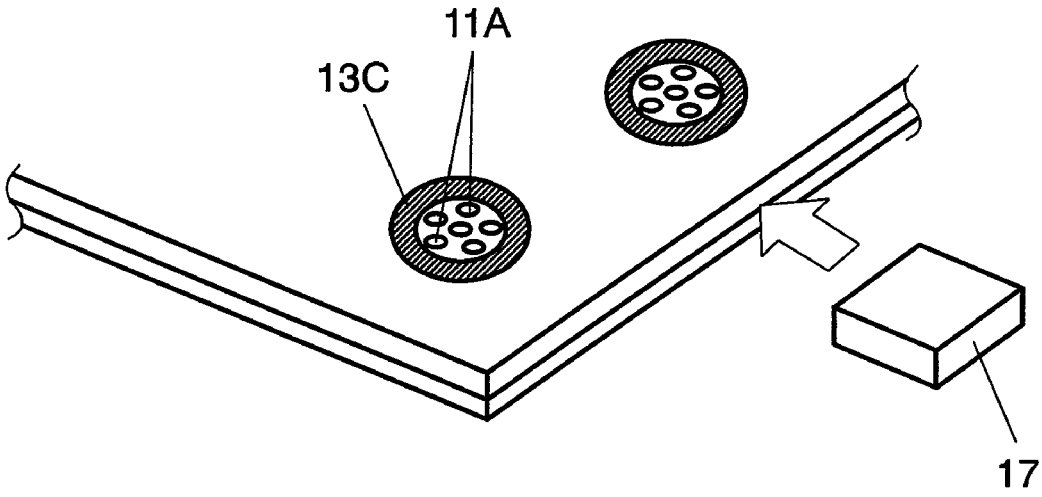
FIG. 4A is a perspective view showing a main part in accordance with an exemplary embodiment of the present invention.
Figure 4B:
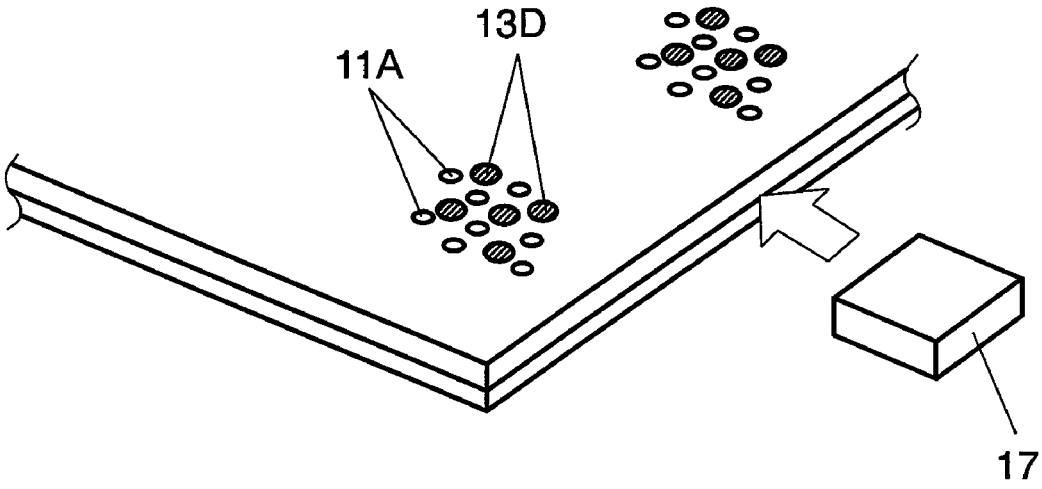
FIG. 4B is a perspective view showing a main part in accordance with an exemplary embodiment of the present invention.

FIG. 4A and FIG. 4B are perspective views showing a main part of another exemplary embodiment of the present invention. The light coming from light emitting device 17 (indicated with an arrow symbol) is illuminating the end-face of base sheet 11. As shown in FIG. 4A, base sheet 11 is provided at the upper surface with fluorescent layer 13C of an approximate ring shape at the location corresponding to movable contact point 3. In the inside and around the ring, reflection sections 11A of a fine uneven shape are provided. By so doing, the illuminating can be made with a synthesized color of the light from light emitting device 17 reflected by reflection sections 11A and the lights emitted from fluorescent layers 13C and 13D. The same effects can be generated by providing instead fluorescent layers 13D and reflection sections 11A in mixed dots, as illustrated in FIG. 4B. Thus, the mode of illuminating can be further enriched by providing reflection sections of a fine uneven shape at the vicinity of fluorescent layers 13.

As described in the above, transparent base sheet 11 in the present embodiment is attached at the lower surface with movable contact point 3 made of thin conductive metal sheet in an approximate dome shape, and fluorescent layer 13 on the upper surface at the location above movable contact point 3. This structure makes it possible to illuminate with many colors other than that generated from light emitting device 17. Thus, movable contact element 15, as well as a switch formed using the movable contact element, offers illumination in various modes with a simple make-up.

Figure 5:
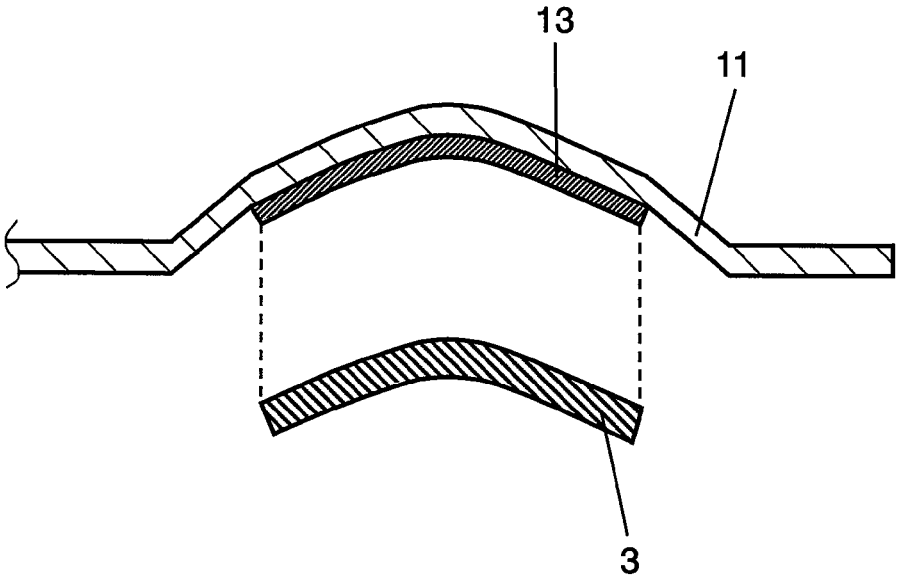
FIG. 5 is a cross sectional view showing a main part in accordance with an exemplary embodiment of the present invention.

The above descriptions have been based on a structure where fluorescent layer 13 is formed on the upper surface of based sheet 11 at the location above movable contact point 3. FIG. 5 is a cross sectional view showing a main part of another exemplary embodiment that is different from that shown in FIG. 1. In FIG. 5, fluorescent layer 13 is provided at the lower surface of base sheet 11, and movable contact point 3 is attached to the lower surface of fluorescent layer 13. The present invention can be embodied also in the above-described structure.

Figure 6:
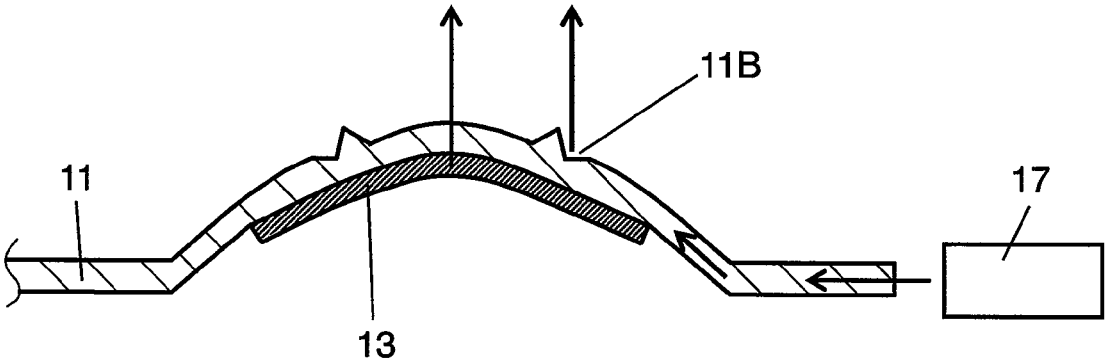
FIG. 6 is a cross sectional view showing a main part in accordance with an exemplary embodiment of the present invention.
Figure 7:
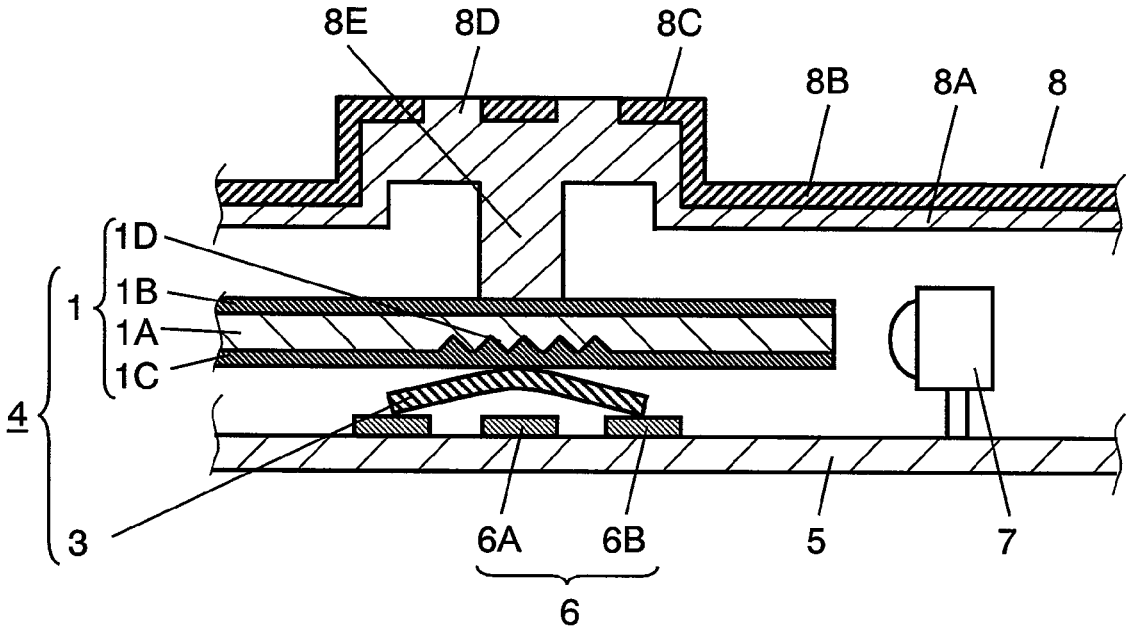
FIG. 7 PRIOR ART
FIG. 7 is a cross sectional view of a conventional switch.

FIG. 6 shows a cross sectional view of a main part showing still another structure that is different from those shown in FIG. 1 and FIG. 4. Reference is made to FIG. 6, base sheet 11 has fluorescent layer 13 formed at the lower surface, and reflection section 11B of a fine uneven shape provided at the upper surface. In this structure, the light from light emitting device 17 entered into base sheet 11 (arrow mark directed towards the left) is reflected upward (upward arrow mark at the right) by reflection section 11B. The light coming from light emitting device 17 is reflected as it is in the original color. At the same time, fluorescent layer 13 also emits light (upward arrow mark at the center). These lights are synthesized and the illuminating is made with a synthesized color. In this way, the illuminating mode can be further enriched by providing a reflection section of a fine uneven shape at the vicinity of fluorescent layer 13.

INDUSTRIAL APPLICABILITY

A movable contact element in accordance with the present invention, as well as a switch formed using the movable contact element, enables illuminating in various modes through a simple structure. So, the present invention would offer a certain advantage for making the operation easier and reliable when it is incorporated in electronic apparatus of many kinds.

The invention claimed is:

1. A movable contact element comprising:

a transparent base sheet, and a movable contact point made of a thin conductive metal sheet in a dome shape attached to a lower surface of the base sheet; wherein a fluorescent layer is provided on an upper surface or the lower surface of the base sheet above the movable contact point, the fluorescent layer comprising a plurality of distinct fluorescent dots, and a reflection section is provided above the movable contact and the fluorescent layer, the reflection section comprising an unevenness in a surface of the base sheet, the reflection section comprising a plurality of distinct reflecting dots.

2. The movable contact element of claim 1; wherein the fluorescent layer is one of a plurality of fluorescent layers, and the plurality of fluorescent layers emit light in different colors, respectively.

3. The movable contact element of claim 1, wherein the reflection section is provided at the vicinity of the fluorescent layer.

4. A switch comprising:

the movable contact element recited in claim 1, the movable contact element being attached on an upper surface of a substrate having a fixed contact point, which faces the movable contact point, on its upper surface.

5. A switch comprising:

the movable contact element recited in claim 2, the movable contact element being attached on an upper surface of a substrate having a fixed contact point, which faces the movable contact point, on its upper surface.

6. A switch comprising:

the movable contact element recited in claim 3, the movable contact element being attached on an upper surface of a substrate having a fixed contact point, which faces the movable contact point, on its upper surface.

7. The movable contact element of claim 2, wherein the plurality of fluorescent layers are located directly above the movable contact.

8. A movable contact element comprising:

a transparent base sheet, and a movable contact point made of a thin conductive metal sheet in a dome shape attached to a lower surface of the base sheet; wherein a fluorescent layer is provided on an upper surface or the lower surface of the base sheet above the movable contact point, the fluorescent layer having an annular shape, and a reflection section is provided above the movable contact and the fluorescent layer, the reflection section comprising an unevenness in a surface of the base sheet, the reflection section positioned inside of the annular-shaped fluorescent layer.

* * * * *